US008800339B2

(12) United States Patent
Marin et al.

(10) Patent No.: US 8,800,339 B2
(45) Date of Patent: Aug. 12, 2014

(54) ROLLING MILL FOR LONG ARTICLES

(71) Applicant: SMS INNSE SpA, San Donato Milanese (IT)

(72) Inventors: Paolo Marin, Vigevano (IT); Marcello Pacher, Bareggio (IT); Claudio Pavesi, Cernusco Sul Naviglio (IT); Guido Emilio Zanella, Milan (IT)

(73) Assignee: SMS INNSE SpA, S. Donato Milanese (IT)

( * ) Notice: Subject to any disclaimer, the term of this patent is extended or adjusted under 35 U.S.C. 154(b) by 0 days.

(21) Appl. No.: 14/094,613

(22) Filed: Dec. 2, 2013

(65) Prior Publication Data

US 2014/0083152 A1 Mar. 27, 2014

Related U.S. Application Data

(63) Continuation of application No. 13/642,487, filed as application No. PCT/IB2011/051222 on Mar. 23, 2011.

(30) Foreign Application Priority Data

Apr. 20, 2010 (IT) ..... MI2010A0672

(51) Int. Cl.
*B21B 13/12* (2006.01)

(52) U.S. Cl.
USPC ..... 72/235; 72/238

(58) Field of Classification Search
USPC ..... 72/224, 234, 235, 237, 238, 239
See application file for complete search history.

(56) References Cited

U.S. PATENT DOCUMENTS 6,041,635 A * 3/2000 Cattaneo et al. ..... 72/235
6,287,208 B1 9/2001 Faulkenberry et al.
2002/0020205 A1* 2/2002 Bindernagel et al. ..... 72/224

FOREIGN PATENT DOCUMENTS

DE 2845052 A1 4/1980
DE 10015285 A1 10/2001

(Continued)

OTHER PUBLICATIONS

Espacenet.com printout of English Abstract for "Rolling stand for rolling mills in general, with three or more controlled and adjustable rollers," by Catteano, F., et al., Italian Patent No. IT 1246032, Sep. 9, 1996, Available: http://worldwide.espacenet.com/publicationDetails/biblio?DB=EPODOC&FT=D&CC=IT&NR=1264032B&KC=B [Accessed May 27, 2013].
International Search Report mailed Nov. 17, 2011, in international Patent Application No. PCT/IB2011/051222 filed Mar. 23, 2011.

(Continued)

*Primary Examiner* — Teresa M Ekiert
(74) *Attorney, Agent, or Firm* — Perkins Coie LLP

(57) ABSTRACT

The invention relates to a rolling mill defining a rolling axis and comprising rolling stations. At least one rolling station comprises a fixed structure, a roll-holder cartridge and three actuators. The cartridge is connected removably to the fixed structure and comprises three rolling rolls. The rolls are movable radially and rotatable about three respective axes. Three actuators of the single-stroke type are mounted on the fixed structure and comprise pistons movable along respective radial axes to impart a force on the rolls for rolling an article. Three gearmotors provide the rolls, by means of spindles, with the torque for feeding the article along the rolling axis. When two pistons are completely retracted, a path is created free from obstacles allowing the cartridge to pass out laterally. Then, one spindle may be subject to a rotation-translation to be removed from the path, the respective gearmotor being fixed on its base.

18 Claims, 15 Drawing Sheets

(56) References Cited

FOREIGN PATENT DOCUMENTS

| | | | |
|---|---|---|---|
| IT | 1264032 | B | 9/1996 |
| WO | WO-9719767 | A1 | 6/1997 |
| WO | WO-2009141414 | A1 | 11/2009 |

OTHER PUBLICATIONS

Written Opinion mailed Oct. 23, 2012, in international Patent Application No. PCT/1132011/051222 filed Mar. 23, 2011.

Co-pending U.S. Appl. No. 13/642,487 by Marin, P. et al., filed Oct. 19, 2012.

* cited by examiner

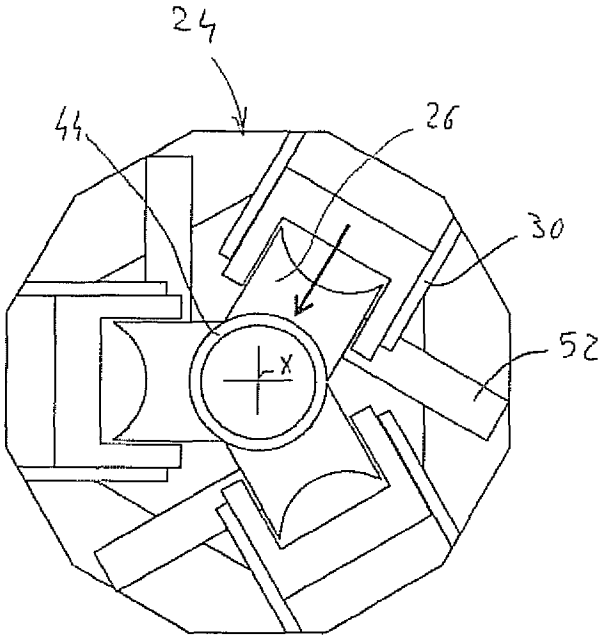
Fig. 3 – PRIOR ART
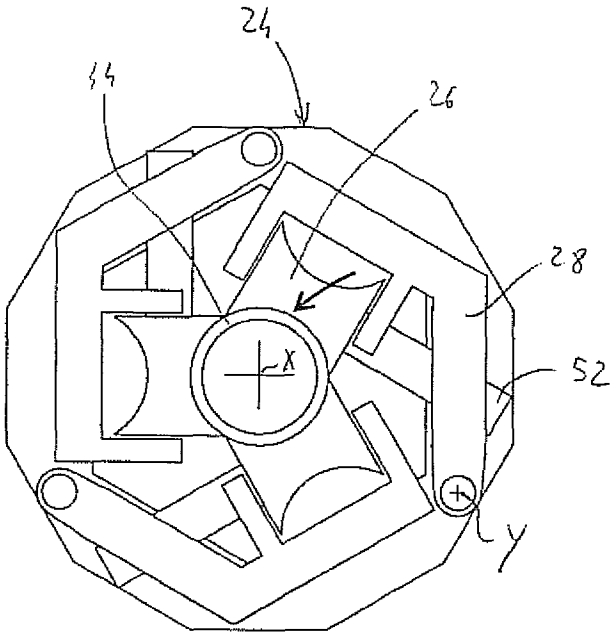
Fig. 2 – PRIOR ART

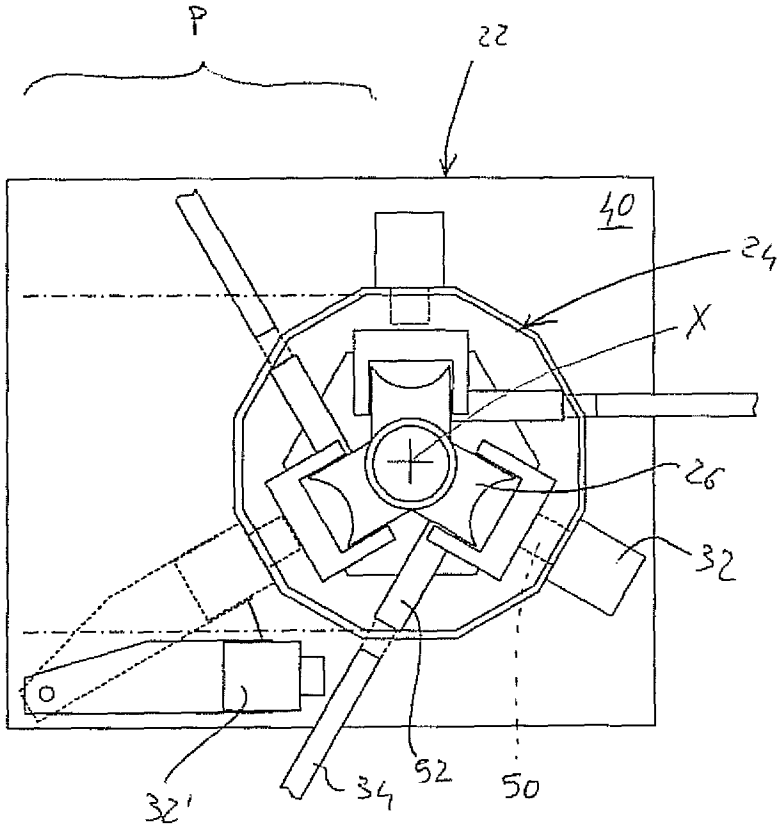
Fig. 5 – PRIOR ART
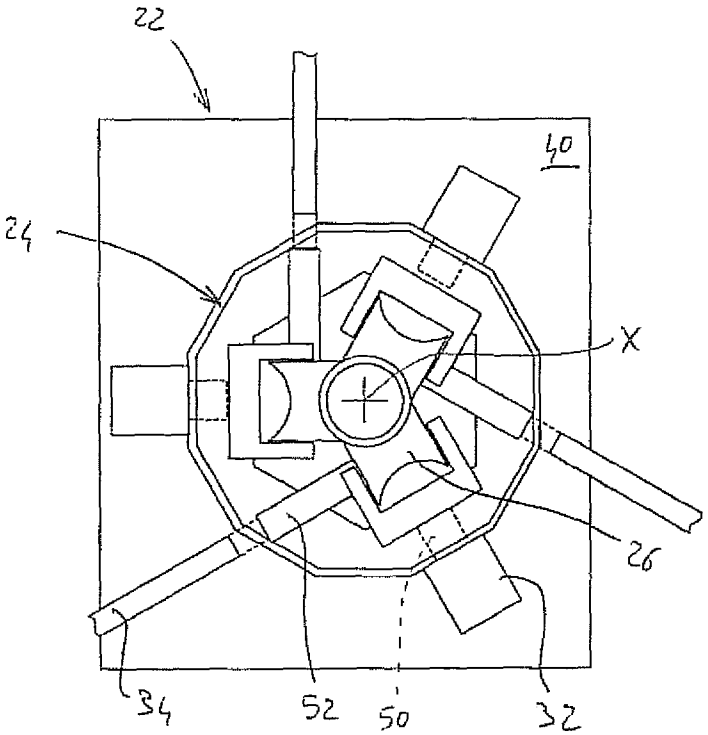
Fig. 4 – PRIOR ART

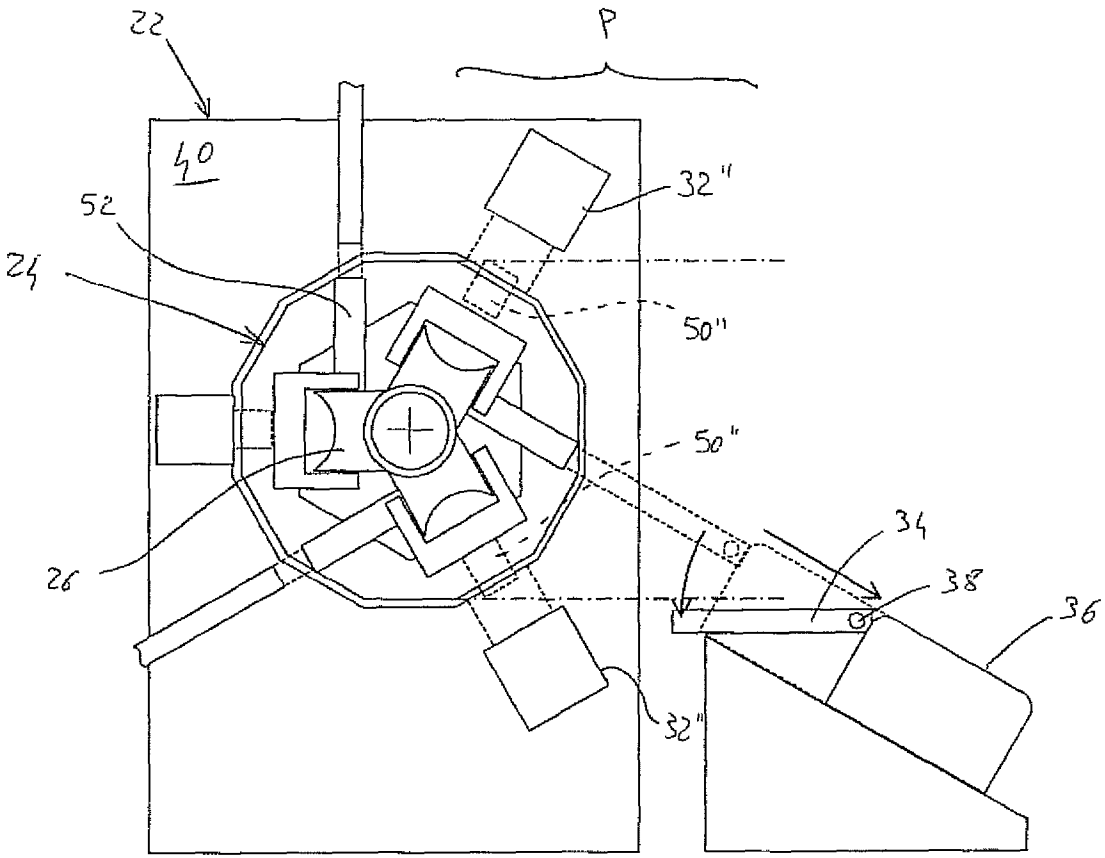
Fig. 6 – PRIOR ART

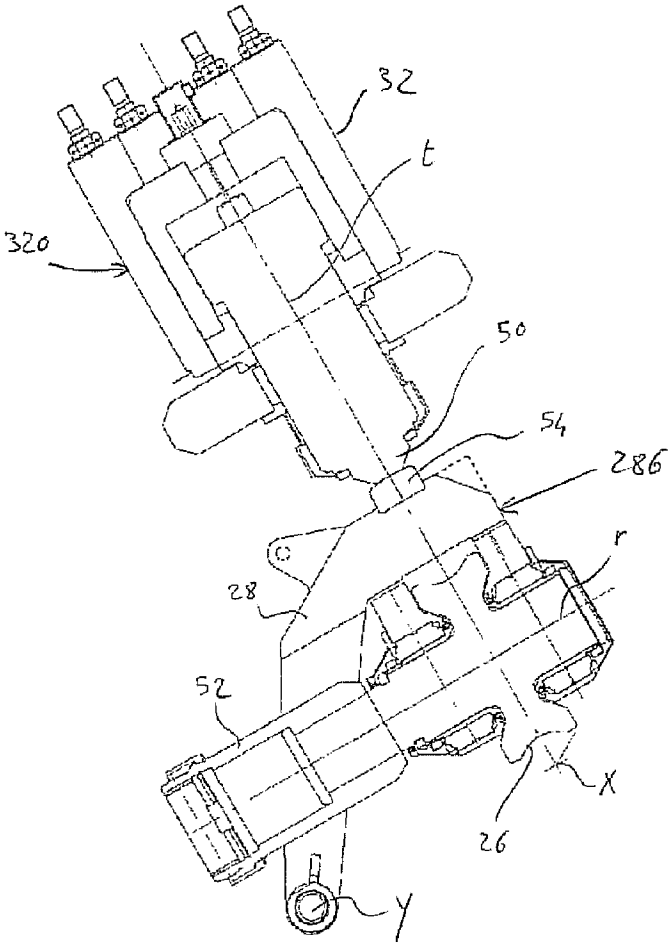
Fig. 14
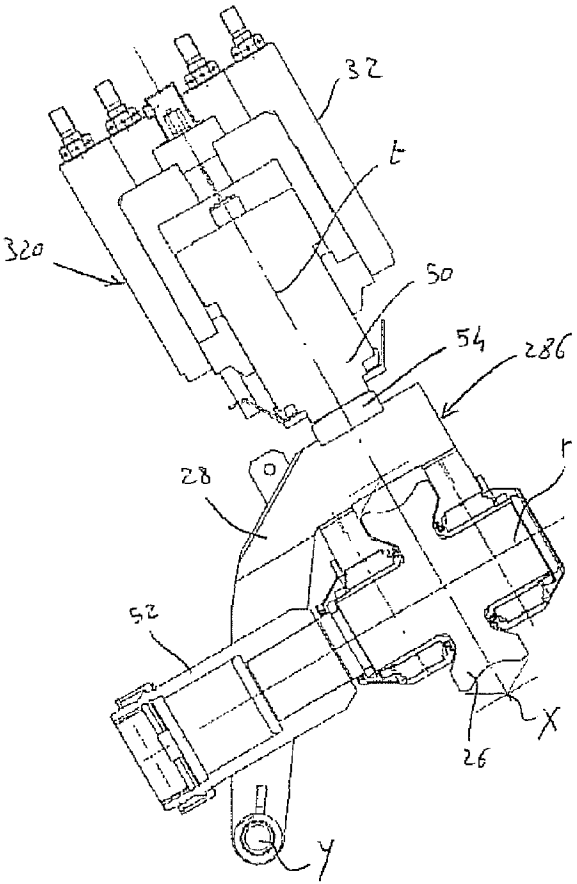
Fig. 13 – PRIOR ART

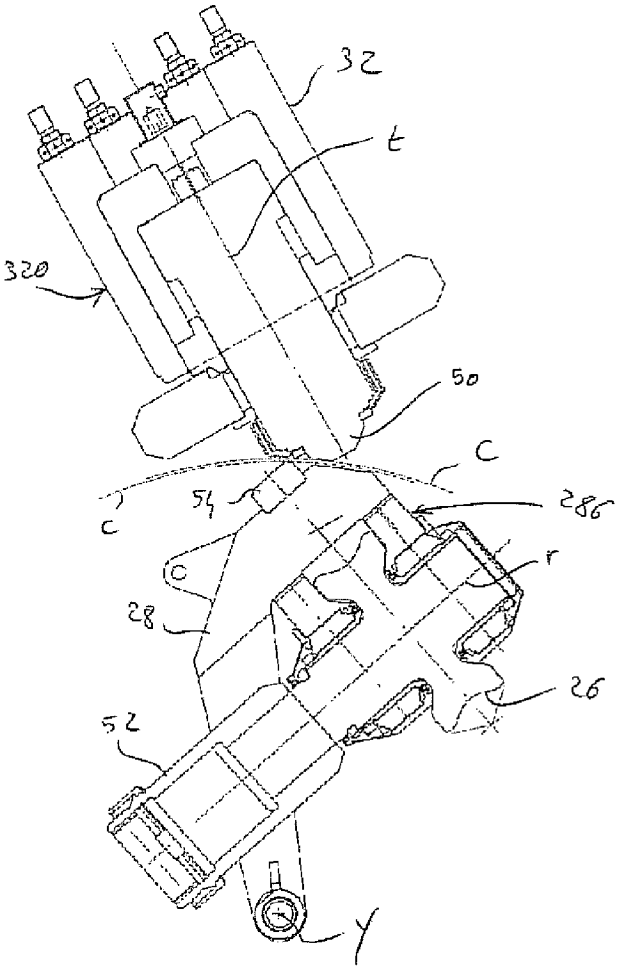
Fig. 16
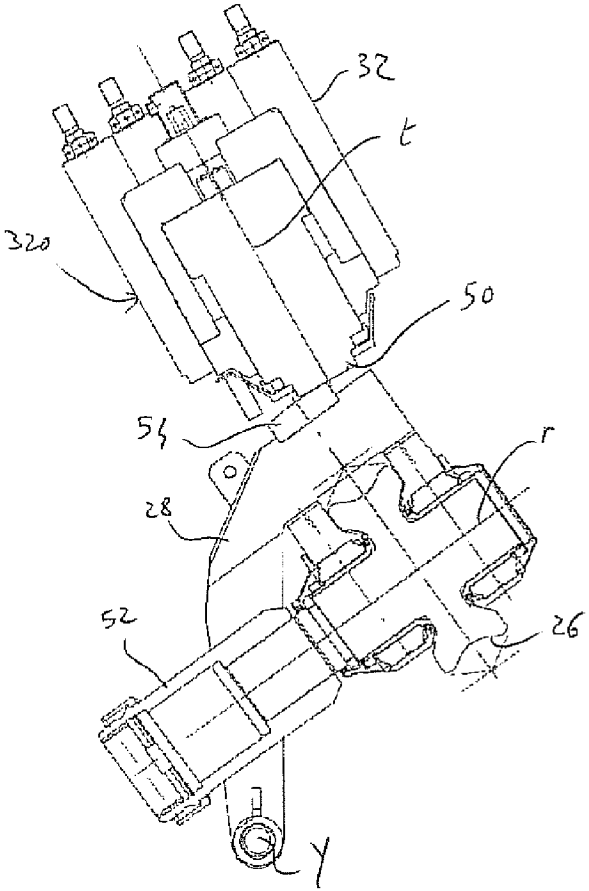
Fig. 15 – PRIOR ART

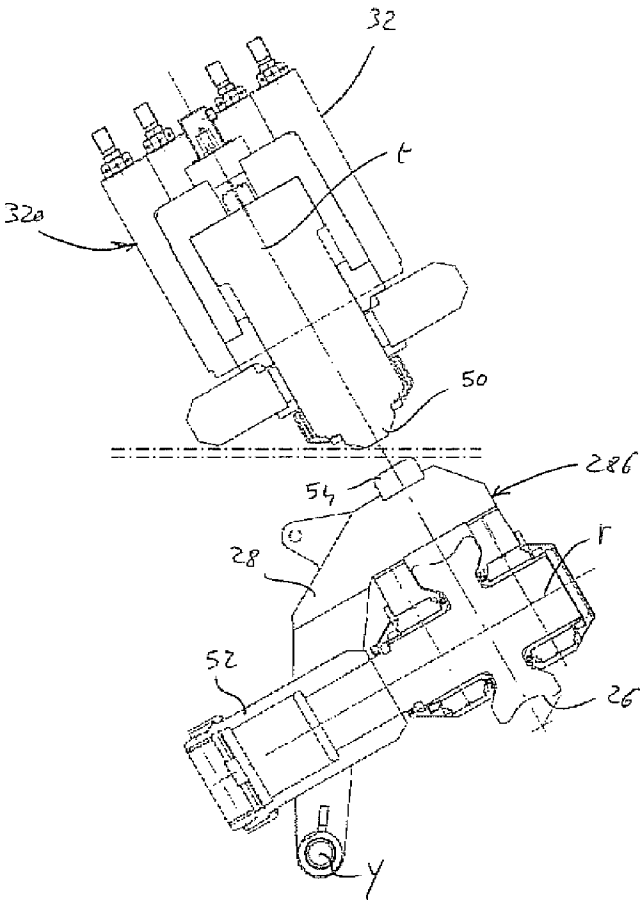
Fig. 18
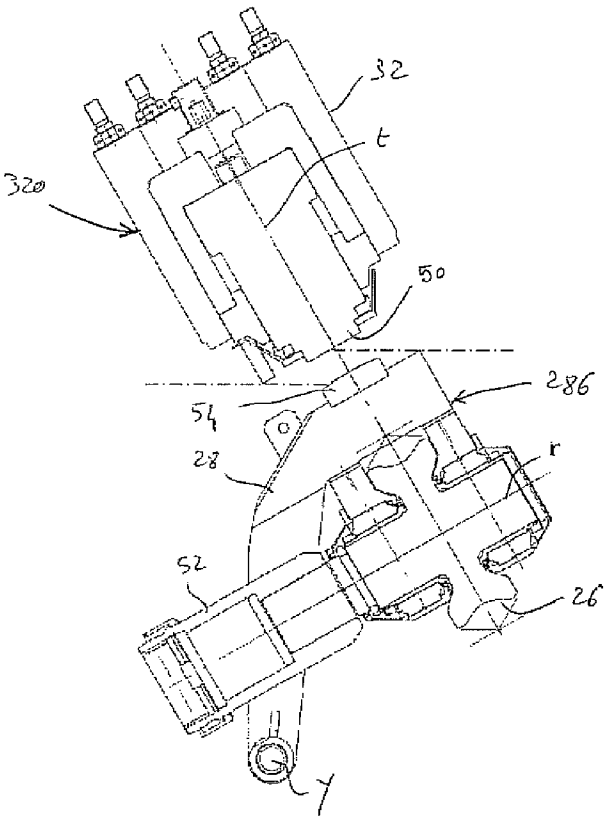
Fig. 17 – PRIOR ART

ROLLING MILL FOR LONG ARTICLES

CROSS-REFERENCE TO RELATED APPLICATIONS

This application is a Continuation Application of U.S. patent application Ser. No. 13/642,487 filed Oct. 19, 2012, which is a 35 USC §371 application of International Application No. PCT/IB2011/051222 filed Mar. 23, 2011, which claims priority to Italian patent application IT MI2010A000672 filed Apr. 20, 2010, both of which are hereby incorporated by reference in their entirety.

DESCRIPTION

The present invention relates to a continuous rolling mill for rolling long hollow and solid articles, such as seamless tubes, bars and rods. In particular it relates to a rolling mill comprising a plurality of stations with three adjustable rolls.

The preferred area of application of the invention is the rolling of seamless tubes, to which particular reference will be made in the description below, without thereby excluding other similar rolling applications.

Continuous rolling mills with three adjustable rolls are widely used in the rolling of seamless tubes, some of the main features of said mills being described below with reference to FIGS. 2 to 6. A continuous rolling mill with three adjustable rolls, denoted in its entirety by 20, typically comprises a plurality of rolling stations 22. Usually, in this type of rolling mill, to which reference will be mainly made below, the stations 22 are five or six in number, each of them comprising in turn a roll-holder cartridge 24 such as that schematically shown in FIGS. 2 and 3. In other types of rolling mill, the number of rolling stations may vary from the two stations used in some sizing mills up to the 24 to 26 stands of certain stretching/reducing mills. The three rolling rolls 26 are mounted on each cartridge 24. In a single station 22 the three rolls 26 are mounted on the respective cartridge 24 at 120° from each other about the rolling axis X. The rolls 26 are also mounted so as to be able to be radially moved according to the rolling requirements.

In accordance with the solution, known per se, schematically shown in FIG. 2, the radial mobility of the rolls 26 is achieved by means of levers 28 hinged on the cartridge 24. Each lever 28 with its associated roll 26 is thus able to rotate about the respective axis of rotation Y, parallel to the rolling axis X. Rotation of the lever 28 and the roll 26 is schematically indicated by the arrow in FIG. 2.

In accordance with the solution, known per se, schematically shown in FIG. 3, the radial mobility of the rolls 26 is achieved by means of guides 30 fixed onto the cartridge 24. Each roll 26 is thus able to be displaced along the respective guide 30. Displacement of the roll 26 is schematically indicated by the arrow in FIG. 3.

In the diagrams of the subsequent FIGS. 4 to 6, the cartridges 24 are shown in a generic form, without an indication as to the presence of the levers 28 or the guides 30.

In each single station 22, such as those schematically shown in FIGS. 4 to 6, the cartridge 24 and the respective rolls 26 co-operate with the actuators 32 and with the spindles 34. The actuators 32 are linear actuators able to act radially against the rolls 26 so as to impart the force necessary for plastic deformation of the material of the article being rolled. Below it is considered that, for the sake of simplicity, the actuators 32 are hydraulic capsules of the cylinder/piston type. The person skilled in the art may understand, however, that, in order to meet specific requirements, these actuators may also be mechanical actuators, for example of the screw or rack type. The spindles 34 are, instead, transmission shafts able to impart to the rolls 26 the torque necessary for causing feeding of the article along the rolling axis X.

FIGS. 4 to 6 show three different known types of rolling stations 22, while the subsequent FIGS. 7 to 12 show rolling stations according to the invention. The characteristic features described above can be easily identified in each of FIGS. 4 to 12.

The rolling mills of the known type, although very popular owing to the quality of the finished article, are, however, not without drawbacks.

A first category of drawbacks consists of those associated with replacement of worn or damaged rolls. The rolls 26, in fact, owing to the fairly severe conditions to which they are exposed during rolling, are subject to a significant degree of wear and a considerable risk of damage. In both cases, in order to restore the rolling mill 20 to its working condition, the damaged rolls must be replaced with a corresponding number of undamaged rolls which are new or reconditioned.

In a first type of rolling mill 20, the need for replacement of the rolls 26 has been catered for by providing a so-called axial change-over system. A station 22 of a rolling mill of this type is shown schematically in FIG. 4. According to this solution, the entire train of roll-holder cartridges 24 may be displaced along the rolling axis X. Obviously, however, in order to be able to displace the train of cartridges 24, it is first required to free the axial path from any obstacles. The main obstacles consist of the actuators 32 and the spindles 34 when these are located in the respective working positions. As schematically shown in FIG. 4, the obstacle consisting of the actuators 32 may be easily removed by retracting the pistons 50 as far as the respective end-of-travel stop of the working stroke. Similarly, the obstacle represented by the spindles 34 may be easily removed by telescopically retracting the ends of said spindles. Once the obstacles have been removed, it is possible to extract axially the train of cartridges 24 and then replace the rolls 26.

The train of cartridges 24, together with the undamaged new rolls 26, may then be displaced along the rolling axis X so that each cartridge 24 returns into the correct position inside the respective station 22.

A plant similar to that schematically shown FIG. 4 is described in the patent EP 0 565 772.

This solution, while being undoubtedly effective, has a number of significant drawbacks. Firstly, it is necessary to provide, immediately downstream of the rolling mill 20, an empty space with a length substantially the same as that of the rolling mill itself. This empty space, which is intended to receive the train of cartridges 24 during maintenance, is substantially of no use during the normal operating life of the rolling mill 20. Moreover, the empty space results in the need for means for conveying the article 44 leaving the rolling mill 20 towards the apparatuses which are intended to perform the subsequent processing steps.

Moreover, the axial change-over system necessarily requires the removal of the entire train of cartridges 24, consisting for example of five or six cartridges, each with its associated three rolls 26, even when just one roll needs to be replaced. It may happen in fact that, from among all 15÷18 rolls in the rolling mill, only one of them suffers accidental damage and must be replaced, while all the remaining rolls are in perfect working order.

A subsequent solution, which partly solves the problems associated with axial change-over, is the solution based on a lateral change-over system. According to this solution, in fact, the single cartridge 24 may be extracted laterally from its station 22. In this case, also, it is obviously necessary to provide a lateral path P which is completely free from obstacles and along which the cartridge 24 can be displaced.

A first type of rolling mill 20 with lateral change-over system is schematically shown in FIG. 5. In this rolling mill 20, one of the three actuators 32 acts along a vertical axis, while the other two actuators act along axes which are arranged at ±120° with respect to the vertical. The lateral exit path P of the cartridge 24 is indicated by the dot-dash line. In this configuration, as may be noted, the greatest obstacle consists in one of the actuators 32 (denoted by 32' in the example of FIG. 5 and arranged at −120° with respect to the vertical) and the spindles 34. According to the solution schematically shown in FIG. 5, the actuator 32' is mounted on the fixed structure 40 of the station 22 so as to be able to rotate, if necessary, about a pin. The obstacle is therefore removed by rotating the entire actuator 32 (in the example in FIG. 5 downwards) so as to free the lateral extraction path P for the cartridge 24. The obstacle formed by the spindles 34 is removed by telescopically displacing their ends, in a manner similar to that described above in connection with the axial change-over system.

A plant similar to that schematically shown FIG. 5 is described in the patent EP 0 593 709.

This type of rolling mill 20 with lateral change-over system, although widely used, is not without drawbacks. The main defect consists in the asymmetry of the stiffness of the actuators. In fact, the hinged actuator 32' may not necessarily have a stiffness which is identical to that of the other two actuators which are rigidly mounted on the fixed structure 40 of the station 22. For this reason, the system of forces generated during rolling is able to be balanced only by assuming an asymmetrical geometry, i.e. one where the real axis of the article 44 does not coincide exactly with the theoretical rolling axis X. Moreover, the fact that the actuator 32' may rotate necessarily requires that the respective line supplying pressurized oil should comprise movable parts, for example sections of flexible tubes. This obviously results in an undesirable constructional complication and introduces a number of critical factors into the plant design.

A second type of rolling mill 20 with lateral change-over system is schematically shown in FIG. 6. In this rolling mill 20, one of the three actuators 32 acts along a horizontal axis, while the other two actuators act along axes which are arranged at ±120° with respect to the horizontal. The lateral exit path P of the cartridge 24 is indicated by the dot-dash line. In this configuration, as may be noted, the greatest obstacle consists of the two actuators 32 arranged at ±120° with respect to the horizontal (indicated by 32" in FIG. 6) and one of the spindles 34. According to the solution schematically shown in FIG. 6, all the actuators 32 are mounted rigidly on the fixed structure 40 of the station 22. Both actuators 32" are, however, of the double-stroke type, i.e. they have a working stroke, similar to that of the actuators described above and used during rolling, and a further extra stroke for movement towards/away from the rolling axis X. The obstacles are therefore removed by completely retracting both pistons 50" of the actuators 32" as far as the end-of-travel stop of the working stroke and the end-of-travel stop of the extra stroke so as to free the lateral path P for extraction of the cartridge 24. The obstacle consisting of the spindle 34 is removed in two stages. Firstly, the entire gearmotor 36 and the spindle 34 connected to it are displaced along a slide. When the displacement is sufficient to prevent the spindle 34 from interfering with the other obstacles of the cartridge 24 and/or the station 22, said spindle 34 is rotated about a special joint 38. In the example shown in FIG. 6, the spindle is rotated downwards so as to free the lateral extraction path P for the cartridge 24.

A plant similar to that schematically shown FIG. 6 is described in the international patent application number WO 2009/141414.

Likewise this type of rolling mill 20 with lateral change-over system is not without drawbacks. The main defect again consists in the asymmetry of the system of stiffnesses which react to the rolling forces. In fact, the two double-stroke actuators 32", owing to their different geometrical form, are unable to generate a reaction identical to that generated by the other single-stroke actuator. Moreover, double-stroke actuators 32" are more complex and more costly than ordinary single-stroke actuators 32. Finally the fact that the gearmotor 36 may be displaced obviously gives rise to an undesirable constructional complication and introduces a number of critical factors into the plant design.

Hitherto the problems and a number of solutions relating to the replacement of damaged rolls have been described. A second category of drawbacks affecting the rolling mills 20 are those associated with the emergency situation referred to as "bellows". This emergency situation is described below, with particular reference to FIGS. 19 and 20 which show schematically two side views of two successive stations 22 of a rolling mill 20 for rolling a tube 44 on a mandrel 42. Emergency situations arising from bellows also occur in different rolling mills, for example for performing rolling without a mandrel or for rolling articles which are not hollow. In order to simplify illustration, the simplified diagrams shown in FIGS. 19 and 20 show, for each station 22, only the rolls 26 and the fixed structures 40, omitting the cartridges 24, the structures which connect the rolls 26 to the cartridges 24, the spindles 34, the various gearmotors 36 and any other superstructure, which not being directly relevant, would have simply complicated illustration thereof.

In FIG. 19 the two stations 22 are shown during normal rolling; for example rolling of a tube 44 on a mandrel 42 is shown. In this case the diagram shows that the rolls 26 performing rolling are functioning correctly. In this configuration, the tube 44 travels along the rolling axis X at a speed which, inside the last rolling stands, may be as high as 5÷6 m/s.

In FIG. 20 the two stations 22 are shown at the moment when, during rolling, so-called bellows occurs. This emergency situation arises when one or more rolls 26 in a station 22 get stuck, therefore preventing the tube 44 from travelling freely downstream. Since, however, the station 22 immediately upstream of the station where sticking of the rolls 26 occurred continues to push the tube 44, the latter is deformed giving rise to so-called bellows 46. It is also likely that, owing to the temperatures, the forces and the speeds which are typical of rolling, the material of the tube 44 may tear. In such a case strips 48 of the material of the tube may expand radially between the rolls 26 and the fixed structures 40.

The rolling mills 20 are commonly provided with safety systems for stopping the plant in the event of malfunctions. It should be noted, however, that the inertia involved and the typical rolling speeds do not allow immediate stoppage. Assuming that the safety system manages to intervene and stop the rolling mill 20 in 0.5 seconds, it can be understood how this may nevertheless result in up to 2.5 to 3 meters of tube 44 being compressed in the interaxial space between two stations 22, together with the tube portion 44 which is normally present there.

The final outcome of this situation is that the material of the tube 44 expands radially, emerging from the profile which is normally provided for the tube 44 being rolled. This deformation, schematically shown in FIG. 20, means that the tube 44 is no longer able to move axially, either downstream or upstream.

In the case of rolling mills 20 of the type with an axial change-over system it is possible to carry out repairs in a relatively simple manner in the event of bellows 46. It is in fact possible to extract axially the entire train of cartridges 24, together with the stuck tube 44. Once the blocked train of cartridges 24 has been removed, another train of cartridges 24 is usually inserted in the operating order so that the rolling mill 20 can resume operation again as soon as possible. It is therefore possible for an operator to repair off-line the stuck train of cartridges 24, for example within the spaces between the cartridges 24 which, during use, are occupied by the fixed structures 40. Typically the operator sections the tube manually, for example using a heat torch, reducing the tube into fragments which can be removed through the free spaces between the rolls 26, the cartridges 24 and the respective connecting structures. Once all the strips 48 of material which emerge radially from the profile which is normally provided for the tube 44 have been removed, the tube may be moved axially again. After removing the tube 44 and if necessary carrying out an overhaul of the rolls 26, the train of cartridges 24 may be inserted again into the rolling mill 20.

On the other hand, in the case of rolling mills 20 of the type with lateral change-over system, it is not so easy to carry out repairs in the event of bellows 46. The cartridges 24 cannot be extracted laterally owing to the tube 44 which is blocked inside and which retains the cartridges. In this case the operator must act directly in situ, for example introducing the heat torch inside the small free spaces between the various structures. This type of operation is extremely laborious and requires great skill and attention on the part of the operator as well as being time-consuming.

The object of the present invention is therefore to overcome at least partly the drawbacks mentioned above with reference to the prior art.

In particular, one task of the present invention is to provide a rolling mill with lateral change-over system which ensures a symmetrical stiffness system for the actuators.

Another task of the present invention is to provide a rolling mill with lateral change-over system which is structurally simple.

A further task of the present invention is to provide a rolling mill with lateral change-over system which allows repairs to be carried out easily in the event of bellows occurring.

The above-mentioned object and tasks are achieved by a rolling mill according to the present invention.

The characteristic features and further advantages of the invention will emerge from the description provided below, of a number of examples of embodiment, provided by way of a non-limiting example, with reference to the accompanying drawings in which:

FIG. 2 shows schematically a front view of a first known type of roll-holder cartridge;

FIG. 3 shows schematically a front view of a second known type of roll-holder cartridge;

FIG. 4 shows schematically a front view of a station of a rolling mill with an axial change-over system of the known type;

FIG. 5 shows schematically a front view of a station of a rolling mill with a lateral change-over system of a first known type;

FIG. 6 shows schematically a front view of a station of a rolling mill with a lateral change-over system of a second known type;

FIG. 13 shows the roll/actuator unit according to the prior art in a working configuration;

FIG. 14 shows the roll/actuator unit according to the invention in a working configuration;

FIG. 15 shows the unit according to FIG. 13 in a different configuration;

FIG. 16 shows the unit according to FIG. 14 in a different configuration;

FIG. 17 shows the unit according to FIG. 13 in a further configuration;

FIG. 18 shows the unit according to FIG. 14 in a further configuration;

Figure 1:
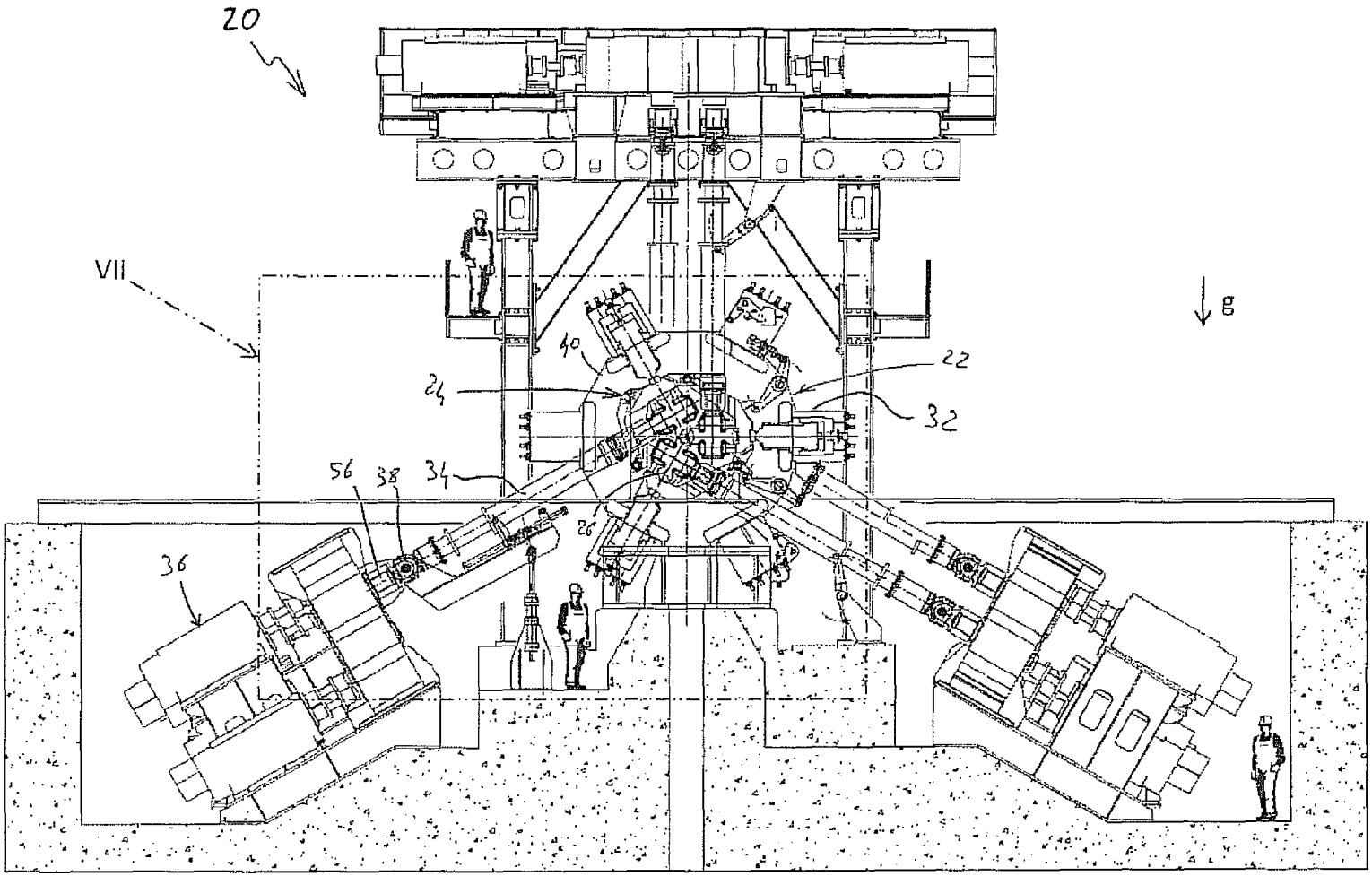
FIG. 1 shows an overall front view of a rolling mill according to the invention in the working configuration.
Figure 7:
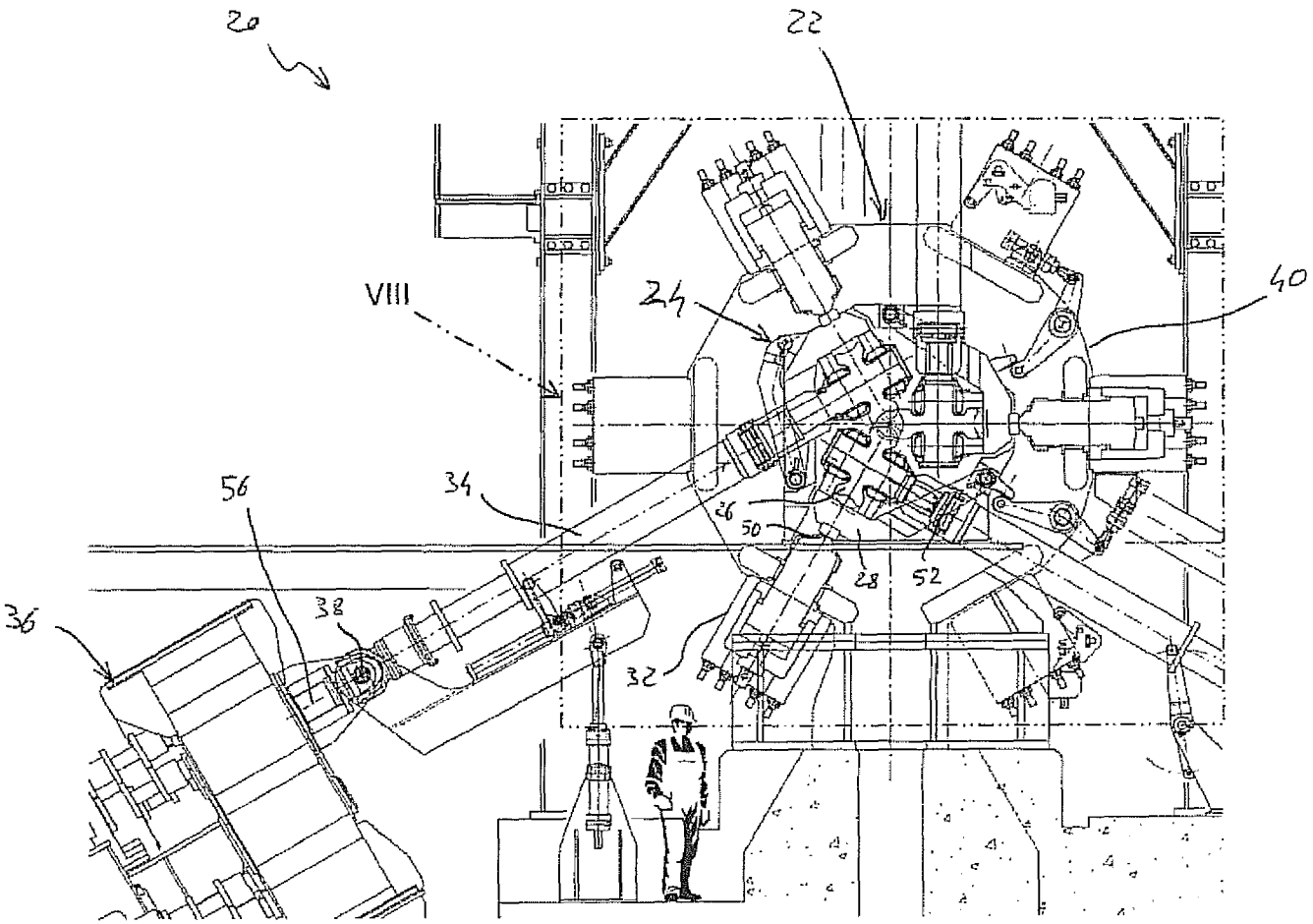
FIG. 7 shows an enlarged view of the detail indicated by VII in FIG. 1.

With reference to the accompanying Figures, 20 denotes in its entirety a continuous rolling mill for rolling a long article 44.

The rolling mill 20 defines a rolling axis X and comprises at least two rolling stations 22 arranged in series along the rolling axis X. Each rolling station 22 comprises a fixed structure 40, a roll-holder cartridge 24 and three actuators 32.*a*, 32.*b* and 32.*c*.

The roll-holder cartridge 24 is connected removably to the fixed structure 40 and comprises three rolling rolls 26.*a*, 26.*b* and 26.*c*. The three rolls are mounted on the roll-holder cartridge 24 so as to be movable radially with respect to the rolling axis X and are rotatable about three respective axes r.a, r.b and r.c arranged at 120° from each other.

In accordance with a first embodiment of the rolling mill 20 according to the invention, the three actuators 32.*a*, 32.*b* and 32.*c* are mounted on the fixed structure 40 and comprise pistons 50.*a*, 50.*b* and 50.*c* which are movable along three respective radial axes t.a, t.b and t.c which are situated at 120° from each other. Each of the actuators 32.*a*, 32.*b* and 32.*c* is able, during use, to act on one of said rolls 26.*a*, 26.*b* and 26.*c* so as to impart a radial force suitable for rolling the article 44.

Figure 8:
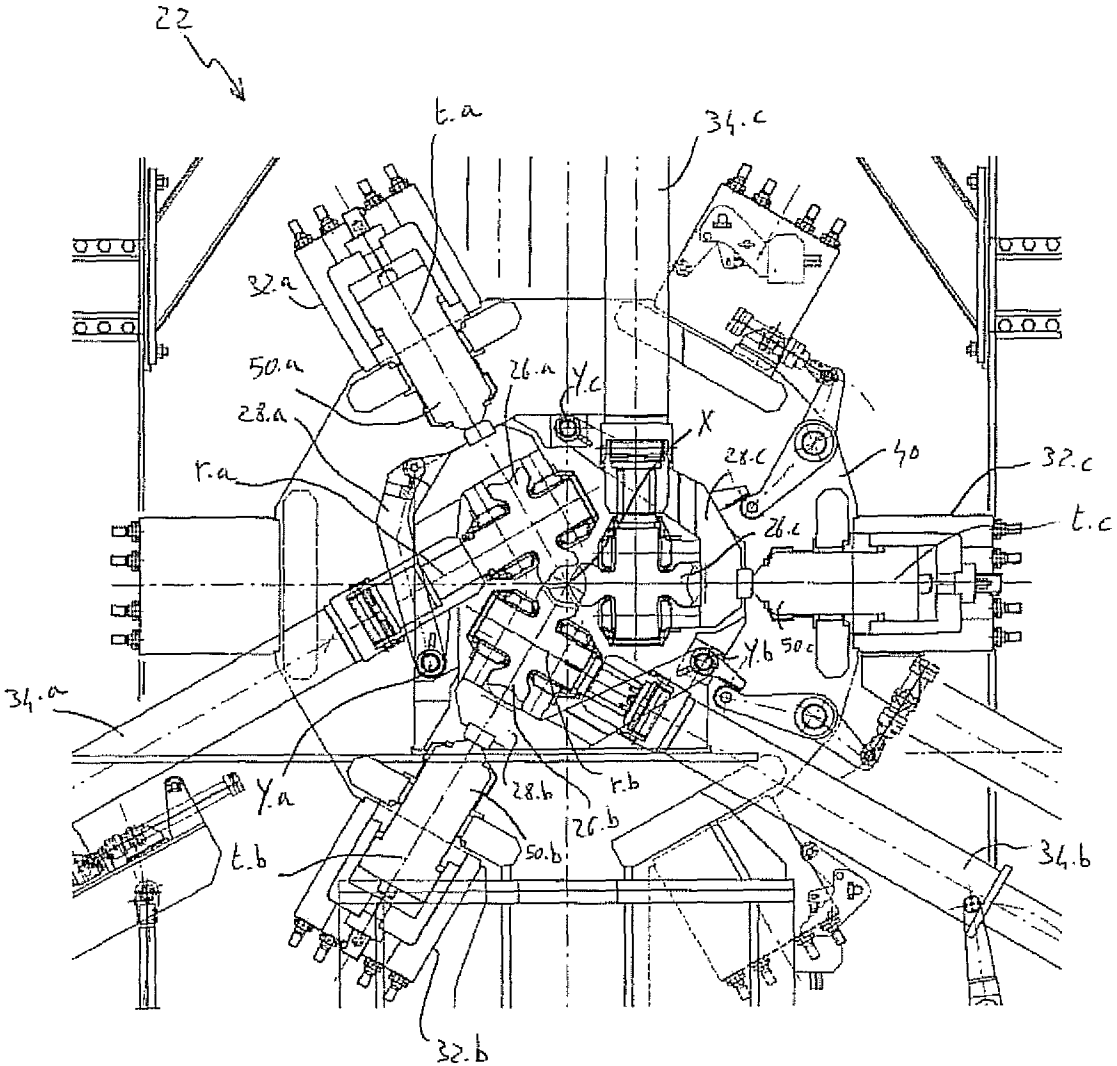
FIG. 8 shows an enlarged view of the detail indicated by VIII in FIG. 7.
Figure 10:
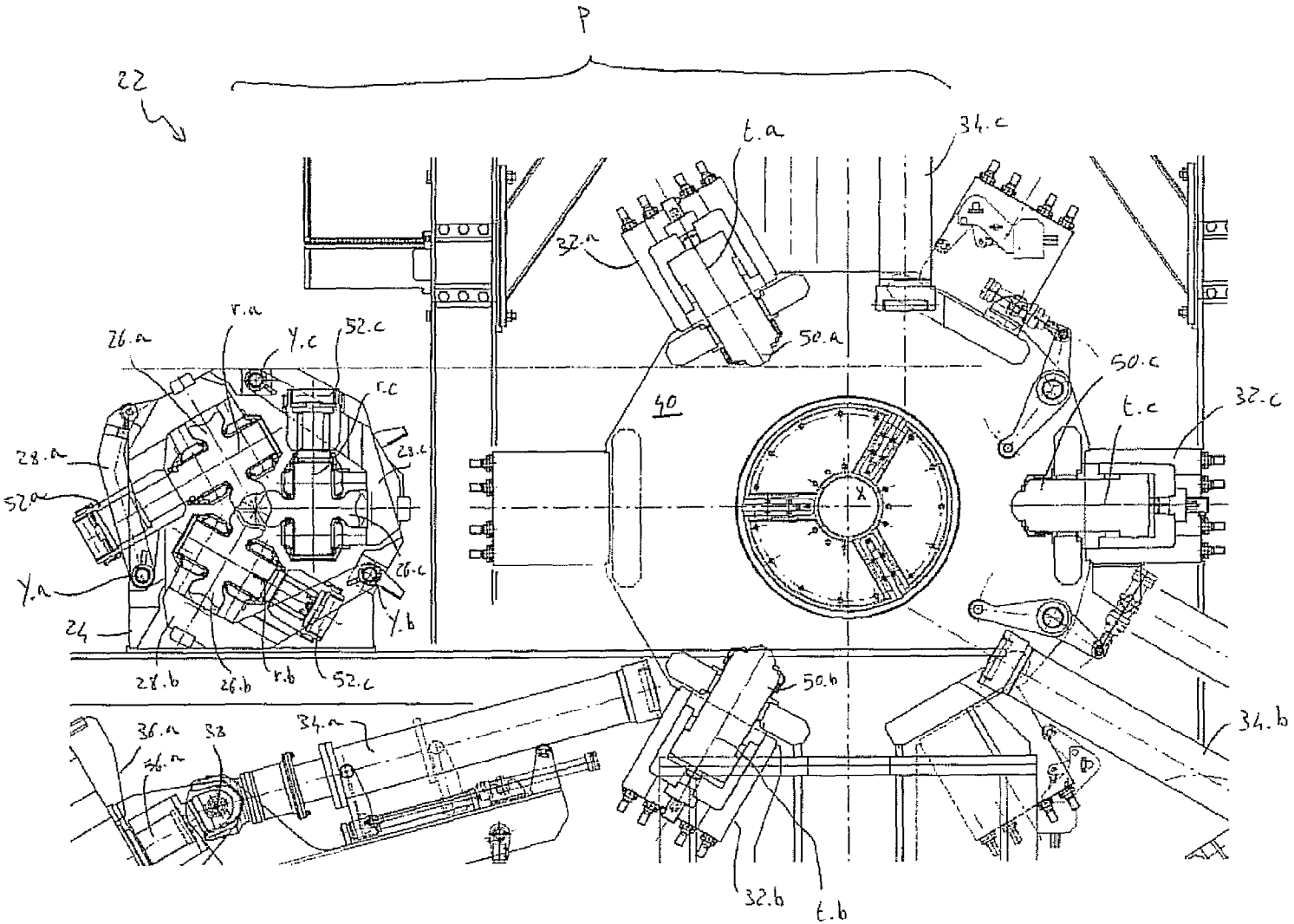
FIG. 10 shows the detail of FIG. 8 in the configuration for changing the cartridge.
Figure 11:
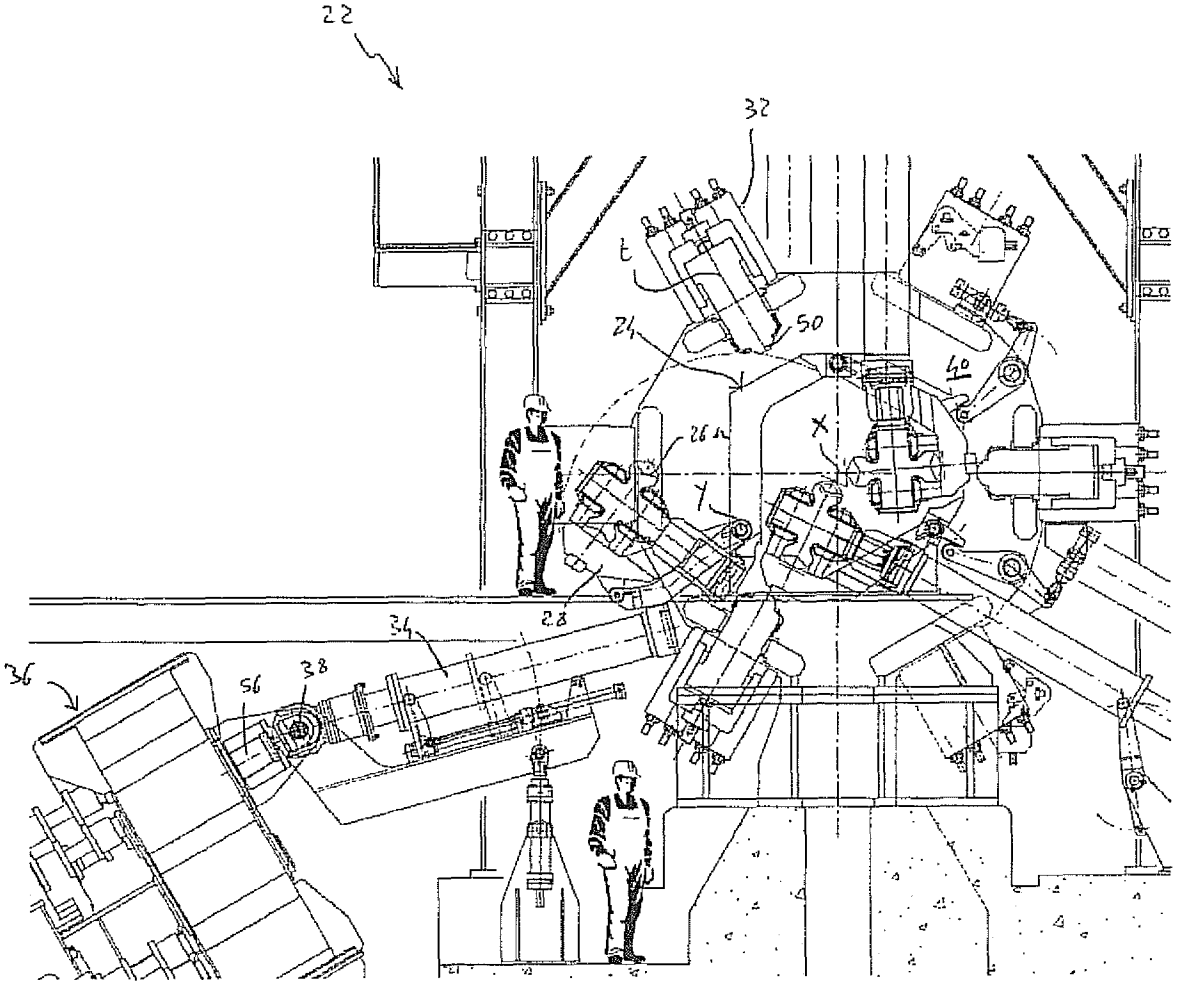
FIG. 11 shows the detail of FIG. 7 in the emergency configuration.
Figure 12:
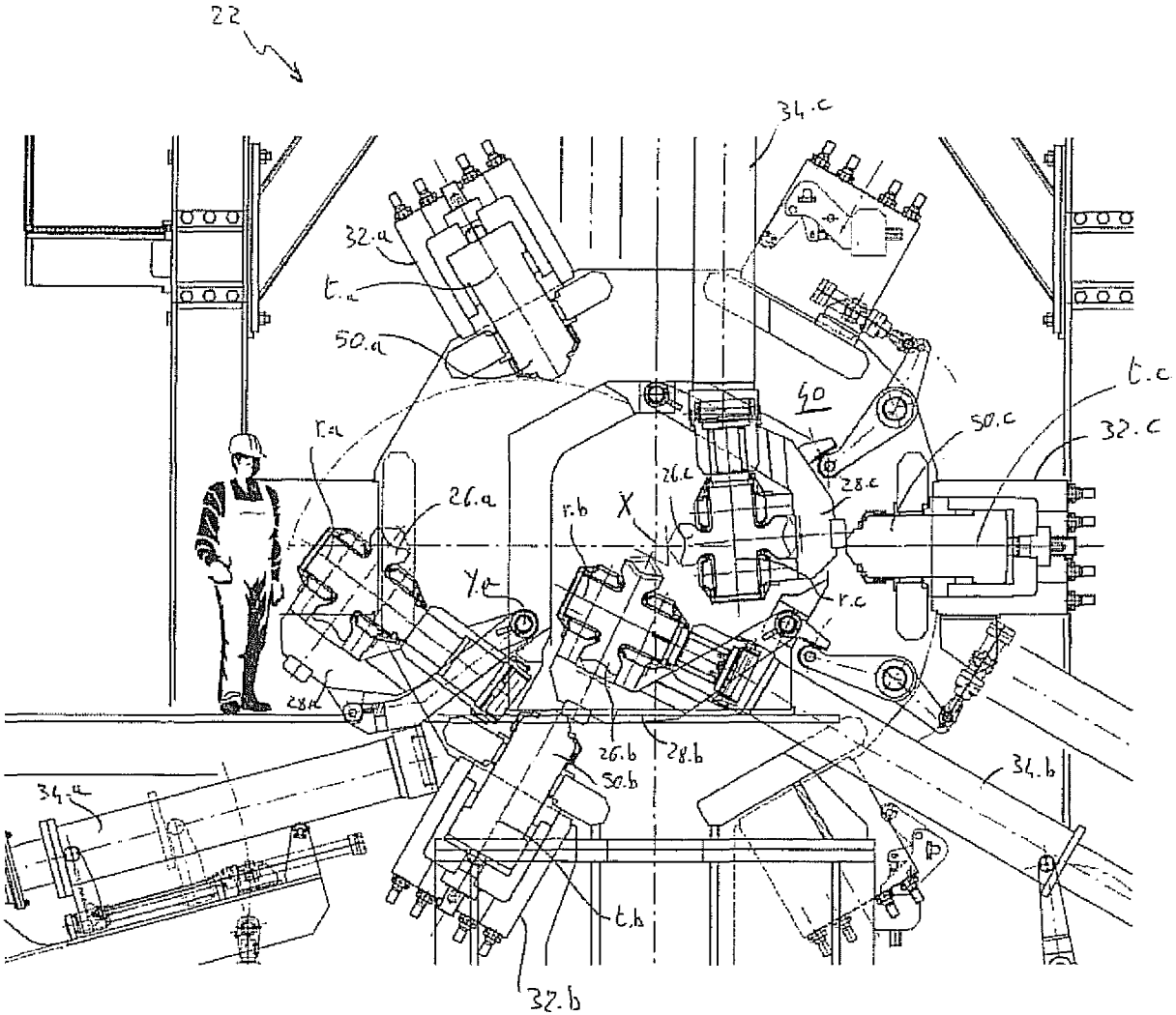
FIG. 12 shows the detail of FIG. 8 in the emergency configuration.
Figure 20:
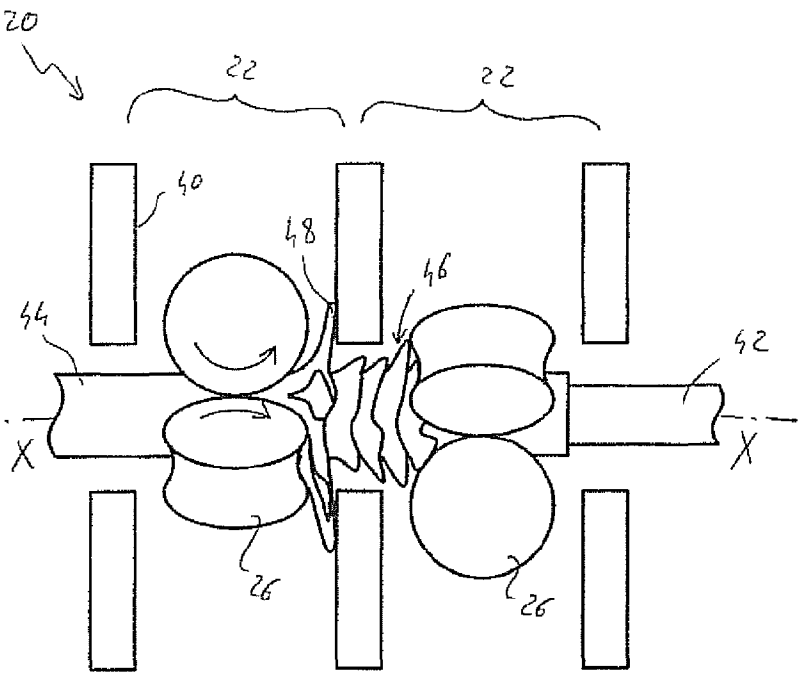
FIG. 20 shows a view, similar to that of FIG. 18, in which an emergency has occurred.
Figure 19:
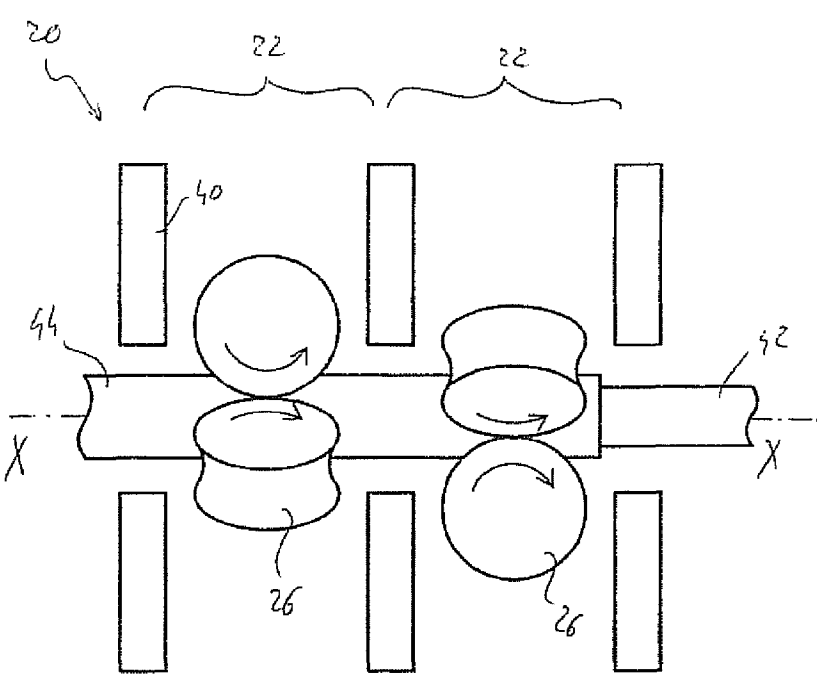
FIG. 19 shows a schematic side view of a rolling mill during rolling of a tube.

In this embodiment, the rolling mill 20 according to the invention is characterized in that the three actuators 32.*a*, 32.*b* and 32.*c* are of the single-stroke type and are arranged so that, when the pistons 50.*a*, 50.*b* of two actuators 32.*a*, 32.*b* are completely retracted to the end-of-travel stop of the working stroke, a path P is created free from obstacles and parallel to the axis t.c of the third actuator 32.*c*. The path P which is created is such as to allow the roll-holder cartridge 24 to pass out laterally on the opposite side to that where the third actuator 32.*c* is situated. See, in particular, in this connection, FIGS. 8 and 10.

In accordance with a second embodiment of the rolling mill 20 according to the invention, at least one rolling station 22 also comprises three gearmotors 36.*a*, 36.*b* and 36.*c* which are connected to the rolls 26.*a*, 26.*b* and 26.*c* by means of spindles 34.*a*, 34.*b* and 34.*c* so as to impart to the rolls 26.*a*, 26.*b* and 26.*c* the torque necessary for causing feeding of the article 44 along the rolling axis X.

In one embodiment, the rolling mill 20 according to the invention is characterized in that at least one spindle 34.*a* may be subject to a rotation-translation movement so as to be removed from a path P which allows the roll-holder cartridge 24 to pass out laterally, the respective gearmotor 36.*a* being mounted in a fixed manner on its base.

As mentioned above, the rolling mill 20 according to the invention specifically defines a rolling axis X. In the present discourse, both as regards the description of the prior art and as regards the description of the invention, the meaning of certain terms is understood as follows: "Axial" is understood as meaning the direction of any straight line parallel to the axis X. "Radial" is understood as meaning the direction of any straight half-line which has its origin on the axis X and is perpendicular thereto. "Lateral" refers to an extension of the concept of "radial"; in other words, the extraction movement of the cartridge 24 is defined as "lateral" because at least one point of the cartridge itself moves in a radial direction, while other points move parallel thereto, but not in a purely radial direction. "Circumferential" is understood as referring to the direction of any circumference which is centered on the axis X and is arranged in a plane perpendicular thereto.

The normal operation of the rolling mill 20 defines, along the direction X, also a rolling direction. With reference to the rolling direction the concepts of "upstream" (i.e. situated ahead in the rolling direction) and "downstream" (i.e. situated after in the rolling direction) are specifically defined.

The rolling milling 20 is also subject to the acceleration of gravity indicated in FIG. 1 by the vector g. The description below refers, except where specifically indicated otherwise, to the rolling mill in the working configuration, i.e. the ordinary concepts of vertical, horizontal, high, low, etc. are specifically defined with reference to the acceleration of gravity g. It is understood that in the reference to "horizontal" and "vertical" directions other directions are also comprised which diverge from the former ones by a little angle, for example ±5°.

Reference is made below mainly to a continuous rolling mill 20 for rolling a seamless tube 44 on a mandrel 42, comprising five or six stations 22. It is understood, however, that said reference is not intended to be limiting, but is instead intended simply to indicate an example of embodiment. The rolling mill 20 according to the invention may therefore be any other type of rolling mill, for example of the type without a mandrel and/or with a different number of rolling stations 22.

In accordance with one embodiment of the rolling mill 20 according to the invention, the actuators 32 are hydraulic capsules.

In accordance with one embodiment of the rolling mill 20 according to the invention, the axis t.c. of the third actuator 32.*c* is horizontal, while the axes t.a, t.b of the other two actuators 32.*a*, 32.*b* are situated at ±120° with respect to the horizontal. This architecture of the rolling station 22 is particularly advantageous because it allows the roll-holder cartridge 24 to pass out laterally, moving in a horizontal plane.

In accordance with one embodiment of the rolling mill 20 according to the invention, the working stroke of the actuators 32 is less than 300 mm, preferably less than 220 mm, and even more preferably less than 180 mm. "Working stroke" is understood as meaning here the entire stroke which may be performed by the piston 50 of an actuator 32. It therefore comprises the rolling stroke, i.e. the distance of about 40 mm over which the piston 50 normally moves during rolling, and the emergency stroke, which is used only when it is required to free the rolling mill in the event of bellows or to extract the cartridge 24.

The values indicated above for the working stroke are substantially comparable to those values considered to be optimal in the prior art, said values being substantially in the region of the 120 to 160 mm. Strokes longer than these values, if on the one hand they may help removal of the obstacles formed by the pistons 50, on the other hand would result in excessive elasticity of an actuator 32 should it be of the hydraulic type. During initial rolling of the tube 44, the actuator 32 must instead be able to develop a reaction which is as stiff as possible so as to be able to respond as directly as possible to the commands of the control circuit which regulates the radial position of the rolls 26.

In accordance with one embodiment of the rolling mill 20 according to the invention, the three actuators 32.*a*, 32.*b* and 32.*c* are identical to each other. This solution is particularly advantageous because it allows a perfect symmetry to be maintained in the stiffness of the actuators acting on the tube 44 during rolling. Moreover the three identical actuators 32 allow more efficient management of the plant from a logistics point of view.

In the rolling mill according to the invention, the radial mobility of the rolls 26 may be obtained, as already mentioned in the prior art, in accordance with at least two different solutions.

In accordance with a first solution, known per se, the radial mobility of the rolls 26 is achieved by means of levers 24 hinged on the cartridge 24. Each lever 28 with the associated roll 26 is thus able to rotate about the respective axis of rotation Y, parallel to the rolling axis X. This solution, referred to as "lever solution", is that shown in FIG. 2.

In accordance with a second solution, which is also known, the radial mobility of the rolls 26 is achieved by means of guides 30 which are fixed on the cartridge 24. Each roll 26 is thus able to slide along the respective guide 30. This solution, referred to as "sliding solution", is that shown in FIG. 3.

Figure 9:
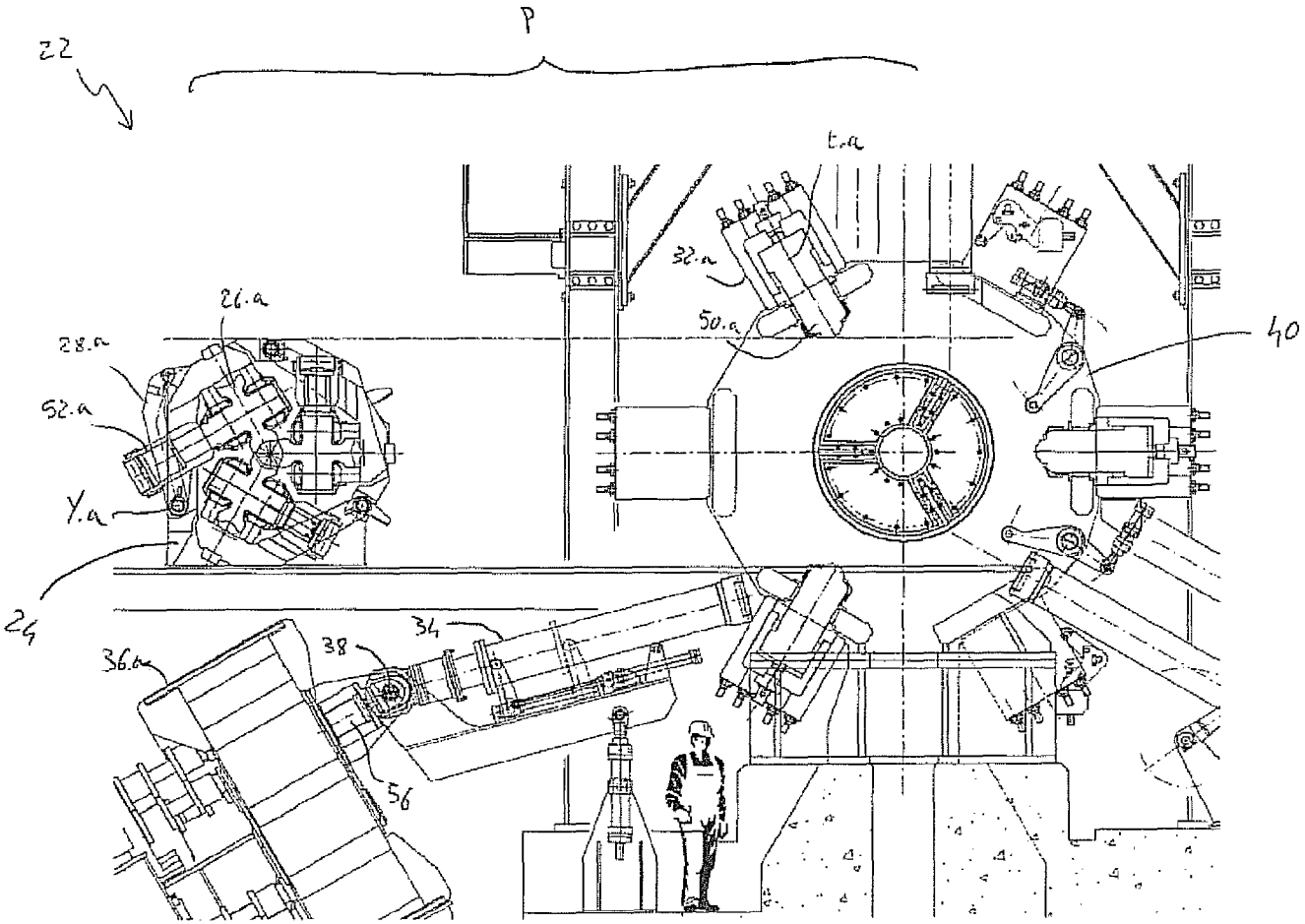
FIG. 9 shows the detail of FIG. 7 in the configuration for changing the cartridge.

In the rolling mill 20 according to the invention, be it of the lever type or sliding type, at least one rolling station 22 is formed so that, when two pistons 50.*a*, 50.*b* are completely retracted to the end-of-travel stop of the working stroke, the minimum distance between the two pistons 50.*a* and 50.*b* and/or between the respective actuators 32.*a* and 32.*b* is greater than the maximum dimension of the cartridge 24 measured in the same direction. This characteristic feature can be clearly seen in FIGS. 9 and 10 where the entire rolling station 22 is shown in the extracted condition of the roll-holder cartridge 24.

FIGS. 17 and 18 show a detailed comparison of two rolling mills of the lever type, one being according to the prior art (FIG. 17) and one being according to the invention (FIG. 18). In both cases the piston 50 of the actuator 32 is fully retracted as far as the end-of-travel stop of the working stroke. In FIG. 17, however, it can be noted how this configuration does not remove completely the obstacles such as to allow lateral extraction of the cartridge 24. On the other hand, in FIG. 18 it can be seen how, as a result of the geometrical configuration of the lever/roll assembly 286 and the actuator/piston assembly 320 according to the invention, a lateral path P which is completely free of obstacles is obtained.

As can be easily noted from a comparison between FIG. 13 and FIG. 14, the solution according to the invention (FIG. 14) differs significantly from the known solution (FIG. 13) owing to a series of geometric details which are of fundamental importance. In particular, it may be noted how the profile of the head of the piston 50 according to the invention has been re-designed so as to reduce its circumferential dimension. Similarly, the profile of the thrust button 54 mounted on the lever 28 and intended to provide the contact surface for the piston 50 has been re-designed.

It should be noted here that, in the lever solution shown, the contact between piston 50 and lever 28 extends substantially in an axial direction, while it extends by only a small amount in the circumferential direction.

The thrust surface 54 provided by the thrust button 54 is in fact a portion of a cylinder with an axis X. Since the head of the piston 50 is usually flat, the contact between the head of the piston 50 and the thrust button 54 in theory concerns a segment. In practice, considering the deformations of the materials, the contact takes place instead along a strip which is centered on the theoretical segment and has a very small, even though finite width. From this characteristic feature relating to the contact between the head of the piston 50 and the thrust button 54 it can be understood how the circumferential extension of the latter is of minor importance when one considers the different working positions which the lever 28 is able to assume during rolling about its axis Y.

In a similar manner to the head of the piston 50 and the thrust button 54, it can be noted how also the lever 28 according to the invention has been re-designed so as to reduce as far as possible its radial dimension with respect to its axis of rotation Y. In particular, its radially outermost edge (shown as a broken line in FIG. 14) has been removed since it did not have any structural function.

It should be noted that the cartridge 24 must be prepared for removal by disconnecting the rolls 26 both from the spindles 34 and from any other auxiliary plant (for example from balance systems or the like). Once free, the rolls 26, which are subject to gravity, may potentially move in an undesirable manner, travelling along the guides 30 or rotating together with the respective levers 28. It is therefore possible that at least one of the rolls 26 may tend spontaneously to move outside of the outer profile of the cartridge 24. This reaction could increase the maximum dimension of the cartridge 24, thus preventing removal thereof. In this case it is necessary to provide stops in order to prevent selectively such unwanted movements and/or opposition means which oppose said movements. Alternatively or in addition, it is also possible to position, along the path P of the cartridge 24, special cam-shaped tracks which allow the rolls to be moved radially inwards so that they occupy again the inside of the outer profile of the cartridge 24.

Owing to the possibility of displacement of the cartridge 24, provided by the structure of the rolling station 22 according to the invention, it is possible to intervene easily in order to change the rolls 26. In particular it may be noted how the cartridge 24 is able to pass out laterally along the rectilinear path P. In the particular embodiment shown in the accompanying figures, the path P is horizontal, this feature facilitating in particular movement both during extraction of the cartridge 24 and during re-insertion thereof.

As already indicated in the prior art according to FIG. 6, the spindle 34, which forms a further obstacle to be eliminated, may also be situated along the path P for lateral removal of the cartridge 24. In the rolling mill 20 according to the invention, as can be clearly seen in the accompanying FIGS. 9 and 10, it is possible to remove very simply the spindle 34 (more specifically the spindle 34.*a*). In fact, as already mentioned above, in the rolling mill 20 according to the invention at least one spindle, for example the spindle 34.*a*, may be subject to a rotation-translation movement in order to be removed from a path P for lateral extraction of the roll-holder cartridge 24, while the respective gearmotor 36.*a* is mounted in a fixed manner on its base.

There are different embodiments of the invention which are able to achieve this result. According to one embodiment, the end of the spindle 34 may be retracted telescopically so as to be disengaged from the hub 52 of the roll 26. According to another embodiment, the entire spindle 34 may be slid along the shaft 56 of the gearmotor 36 so as to be disengaged from the hub 52 of the roll 26.

Figure 22:
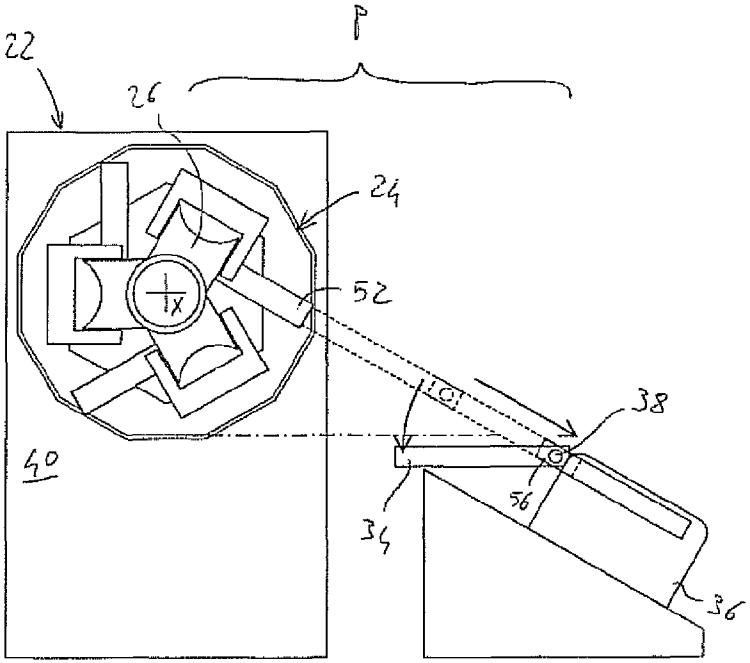
FIG. 22 shows another embodiment of the rolling mill according to the invention in a view similar to that of FIG. 6.
Figure 21:
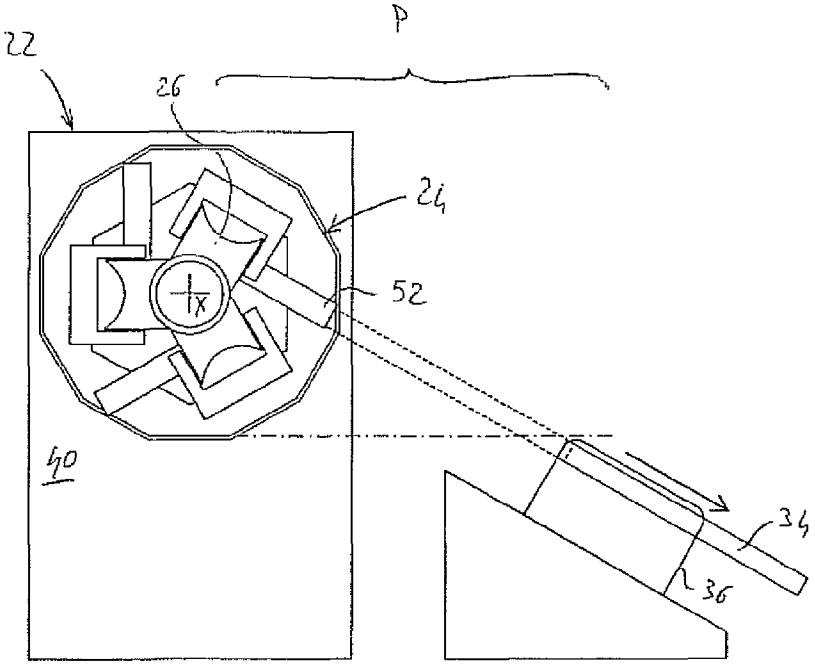
FIG. 21 shows an embodiment of the rolling mill according to the invention in a view similar to that of FIG. 6.

After disengaging the spindle 34 from the hub 52, it may be required to fold back the spindle 34 about a joint 38 in order to remove it from the path P. The configuration of the spindle 34 telescopically disengaged from the hub 52 and folded back about a joint 38 is shown in FIGS. 9 to 12. FIG. 21 shows instead a configuration where the entire spindle 34 is disengaged from the hub 52 and removed from the path P by means of mere sliding along the shaft 56 of the gearmotor 36. FIG. 22 shows instead a configuration where the spindle 34 is disengaged from the hub 52 by means of sliding along the shaft 56 and is removed from the path P by means of rotation about the joint 38.

According to these solutions it is therefore not required to move the gearmotor 36.*a* which may therefore be mounted in a fixed manner on its base, exactly in the same way as the other gearmotors 36.*b* and 36.*c*. The solution according to the invention may be obtained, if necessary, by increasing slightly, compared to the prior art, the telescopic travel of the end of the spindle 34 and/or by lengthening, again compared to the prior art, the hub 52.*a* of the roll 26.*a*.

The joint 38 is able, in a manner known per se, to transmit the torques which are typical of rolling both when the spindle 34 is perfectly aligned with the shaft 56 of the gearmotor 36 and when the spindle 34 forms a small angle (generally ±2°, and more often only ±1°) with this shaft 56. The spindle 34 must in fact follow, during rolling of the tube 44, the radial movements of the roll 26 to which it is connected. The joint 38 is also able to allow the spindle 34 to form an angle of amplitude which is much bigger, typically greater than 10° (15° in the example shown in FIGS. 9 and 10), so that it may be removed from the path P. It should be noted that, in this condition, unlike that which happens during the small angular movements which the spindle 34 performs in order to follow the roll 26 during rolling, the gearmotor 36 is off and/or the spindle 34 does not transmit any torque. The joint 38 may be a universal or Cardan joint, a tooth joint or any other type of joint known in the art which allows to obtain the same result.

The particular form of the rolling mill 20 according to the invention, when of the lever type, is able to provide also further advantages which are described below with particular reference to FIGS. 11, 12, 15 and 16. For at least one of the three actuator/roll units of at least one rolling station 22 it is possible to define two concentric circumferences indicated by c and C, respectively. The circumference c is defined, considering for example the lever 28.*a* and the respective roll 26.*a*, as the smallest circumference which is centered on the axis of rotation (in the example the axis Y.a) of the lever 28.*a* and comprises entirely the lever/roll assembly 286. The circumference C is defined, considering again the lever 28.*a* and the respective roll 26.*a*, as the largest circumference which is centered on the axis of rotation (in the example the axis Y.a) of the lever 28.*a* and does not comprise any portion of the actuator/piston assembly 320 when the piston 50.*a* is completely retracted inside the actuator 32.*a*. Owing to the particular form of the rolling mill 20 according to the invention, the circumference c is smaller than the circumference C. This characteristic feature allows, in an emergency situation, rotation of the lever/roll assembly outwards, thus resulting in the configuration shown in FIGS. 11 and 12 where the entire rolling station 22 is shown in the emergency configuration. In order to achieve this result, the spindle 34 must be folded back as already described above in relation to extraction of the cartridge 24 (see FIGS. 11 and 12 in this connection).

FIGS. 15 and 16 show, instead, in connection with this characteristic feature, a detailed comparison of a lever rolling mill according to the prior art (FIG. 15) and a lever rolling mill according to the invention (FIG. 16). In both cases the piston 50 of the actuator 32 is fully retracted as far as the end-of-travel stop of the working stroke. In FIG. 15, however, it can be noted how this configuration does not remove completely the obstacles such as to allow rotation outwards of the lever/roll assembly 286. On the other hand, in FIG. 16 it can be seen how, as a result of the geometrical configuration of the lever/roll assembly 286 and the actuator/piston assembly 320 according to the invention, it is possible to free completely the trajectory for rotation.

Owing to the possibility of outwards rotation of the lever/roll assembly 286, provided by the structure of the rolling station 22 according to the invention, it is possible to carry out repairs easily in the case of so-called bellows. As can be noted in FIG. 11 and even more clearly in FIG. 12, the outwards rotation of the lever/roll assembly 286 frees a large space which allows the operator to gain easy access to the tube 44. This easy access therefore allows, where necessary, the rolling mill 20 to be freed with removal of the bellows 46 and/or the strips 48 which protrude from the profile of the tube 44.

In the light of the above description it will be clear to the person skilled in the art how the rolling mill 20 according to the invention is able to overcome most of the drawbacks mentioned above with reference to the prior art.

In particular it will be clear to the person skilled in the art how the rolling mill 20 according to the invention is able to ensure symmetry in the stiffness of the actuators and therefore a symmetrical geometry during rolling.

Moreover, it will be clear how the rolling mill 20 according to the invention allows lateral changing of the cartridge 24 and at the same time results in a simple structure of the rolling station 22.

Finally it will be clear how in the case of the rolling mill 20 according to the invention it is extremely easy to carry our repairs in the event of bellows 46.

With regard to the embodiments of the rolling mill 20 described above, the person skilled in the art may, in order to satisfy specific requirements, make modifications to and/or replace elements described with equivalent elements, without thereby departing from the scope of the accompanying claims.

The invention claimed is:

1. A continuous rolling mill for rolling an article defining a rolling axis X, comprising at least two rolling stations arranged in series along the rolling axis X, wherein at least one rolling station includes:

a fixed structure;

a roll-holder cartridge connected removably to the fixed structure and comprising three rolling rolls mounted on the roll-holder cartridge so as to be movable radially with respect to the rolling axis X, the three rolls being rotatable about three respective axes arranged at 120° from each other;

three actuators mounted on the fixed structure and comprising pistons movable along three respective radial axes arranged at 120° from each other, each of said actuators being able, during use, to act on one of said rolls so as to impart a radial force suitable for the rolling of the article;

wherein the three actuators are of the single-stroke type and are arranged so that, when the pistons of two actuators are completely retracted to the end-of-travel stop of the working stroke, a path P is created free from obstacles and parallel to the axis of the third actuator, said path P allowing the roll-holder cartridge to pass out laterally on the opposite side to that where the third actuator is situated.

2. The rolling mill according to claim 1, also comprising three gearmotors connected to the rolls by means of spindles so as to provide the rolls with the torque necessary for causing feeding of the article along the rolling axis X;

wherein at least one spindle may be subject to a rotation-translation movement so as to be removed from a path P which allows the roll-holder cartridge to pass out laterally, the respective gearmotor being mounted in a fixed manner on its base.

3. The rolling mill according to claim 2, wherein the end of the spindle may be retracted telescopically so as to be disengaged from the hub of the roll.

4. The rolling mill according to claim 3, wherein the spindle may be slid along the shaft of the gearmotor so as to be disengaged from the hub of the roll.

5. The rolling mill according to claim 4, wherein the spindle may be folded back around a joint so as to be removed from the path P.

6. The rolling mill according to claim 5, wherein said joint is a universal or Cardan joint.

7. The rolling mill according to claim 1, wherein at least one rolling station is configured so that, when two pistons are completely retracted to the end-of-travel stop of the working stroke, the minimum distance between the two pistons and/or between the respective actuators is greater than the maximum dimension of the cartridge measured in the same direction.

8. The rolling mill according to claim 1, wherein the axis of the third actuator and the path P are horizontal and the axes of the other two actuators are arranged at ±120° with respect to the horizontal.

9. The rolling mill according to claim 8, wherein the working stroke of the actuators is less than 300 mm.

10. The rolling mill according to claim 9, wherein the three actuators are identical to each other.

11. The rolling mill according to claim 10, wherein the three rolling rolls are mounted on the roll-holder cartridge by means of respective guides fixed onto the cartridge so as to be able to slide in a radial direction along the guides.

12. The rolling mill according to claim 11, wherein the three rolling rolls are mounted on the roll-holder cartridge by means of respective levers which are hinged on the roll/holder cartridge so as to be able to rotate about three respective axes of rotation parallel to the rolling axis.

13. The rolling mill according to the claim 12, wherein for at least one roll-actuator unit of the at least one rolling station:

having defined the circumference c as the smallest circumference centered on the axis of rotation of the lever which comprises completely the lever/roll assembly, and having defined the circumference C as the largest circumference centered on the axis of rotation of the lever which does not comprise any portion of the actuator/piston assembly when the piston is completely retracted inside the actuator;

the circumference c is smaller than the circumference C such that the lever/roll assembly may rotate outwards, opening a space for accessing the article.

14. A continuous rolling mill for rolling an article defining a rolling axis X, comprising at least two rolling stations arranged in series along the rolling axis X, wherein at least one rolling station includes:

a fixed structure;

a roll-holder cartridge connected removably to the fixed structure and comprising three rolling rolls mounted on the roll-holder cartridge so as to be movable radially with respect to the rolling axis X, the three rolls being rotatable about three respective axes arranged at 120° from each other;

three gearmotors connected to the rolls by means of spindles so as to provide the rolls with the torque necessary for causing feeding of the article along the rolling axis X;

wherein at least one spindle may be subject to a rotation-translation movement so as to be removed from a path P which allows the roll-holder cartridge to pass out laterally, the respective gearmotor being mounted in a fixed manner on its base.

15. The rolling mill according to claim 14, also comprising three actuators mounted on the fixed structure and comprising pistons movable along three respective radial axes arranged at 120° from each other, each of said actuators being able, during use, to act on one of said rolls so as to impart a radial force suitable for the rolling of the article;

wherein the three actuators are of the single-stroke type and are arranged so that, when the pistons of two actuators are completely retracted to the end-of-travel stop of the working stroke, a path P is created free from obstacles and parallel to the axis of the third actuator, said path P allowing the roll-holder cartridge to pass out laterally on the opposite side to that where the third actuator is situated.

16. The rolling mill according to claim 14, wherein at least one rolling station is configured so that, when two pistons are completely retracted to the end-of-travel stop of the working stroke, the minimum distance between the two pistons and/or between the respective actuators is greater than the maximum dimension of the cartridge measured in the same direction.

17. The rolling mill according to claim 14, wherein the three actuators are identical to each other.

18. The rolling mill according to claim 14, wherein the three rolling rolls are mounted on the roll-holder cartridge by means of respective guides fixed onto the cartridge so as to be able to slide in a radial direction along the guides.

* * * * *